US005676489A

United States Patent [19]

Willhoite

[11] Patent Number: 5,676,489

[45] Date of Patent: Oct. 14, 1997

[54] HAND-HELD SCREED FOR SIDEWALKS

[76] Inventor: Stanley Willhoite, 3245 N. Geronimo #B, Tucson, Ariz. 85705

[21] Appl. No.: 578,219

[22] Filed: Dec. 26, 1995

Related U.S. Application Data

[60] Provisional application No. 60/002,921, Aug. 29, 1995.

[51] Int. Cl.[6] ..... E01C 19/12

[52] U.S. Cl. ..... 404/93; 404/97; 404/101

[58] Field of Search ..... 404/74, 93, 96, 404/97, 87, 101; 15/235.3, 235.4, 235.5, 235.8

[56] References Cited

U.S. PATENT DOCUMENTS

| | | | |
|---|---|---|---|
| 818,416 | 4/1906 | Connelly | 404/97 |
| 1,306,135 | 6/1919 | Bricker | 404/97 X |
| 2,018,890 | 10/1935 | Heltzel | 15/235.4 |
| 2,934,937 | 5/1960 | Bennett | 404/97 X |
| 3,451,179 | 6/1969 | Kendzia | 52/370 |
| 4,114,220 | 9/1978 | Pfister | 15/235.4 X |
| 4,520,527 | 6/1985 | Maggio et al. | 15/235.8 |
| 4,591,291 | 5/1986 | Owens | 404/118 |
| 4,752,154 | 6/1988 | Valentine | 404/72 |
| 4,921,372 | 5/1990 | Hybertson | 404/97 X |
| 5,115,536 | 5/1992 | Jarvis | 15/235.8 |
| 5,190,401 | 3/1993 | Wilson | 404/118 |
| 5,269,625 | 12/1993 | Stewart | 404/97 |
| 5,324,085 | 6/1994 | Hintz, Jr. | 294/16 |

*Primary Examiner*—James Lisehora
*Attorney, Agent, or Firm*—Antonio R. Durando

[57] ABSTRACT

A hand-held screed for use in making a sidewalk includes a rectangular plate. The plate has a bottom edge suitable for subgrading and for levelling concrete, and a top edge opposite the bottom edge. At either end of the plate, a projection extends beyond the top edge. A handle is affixed to one of the major surfaces of the plate and is braced by a pair of struts. The plate has a width, as measured between the top and bottom edges, equal to the intended depth of the sidewalk. The plate further has a length equal to the intended width of the sidewalk. A form is erected and the area within the form is subgraded using the bottom edge of the plate. The plate is oriented with its length dimension running widthwise of the form. When the top edge of the plate is flush with the top edges of the form, the depth of the area within the form equals the intended depth of the sidewalk. Concrete is now poured into the form and the wet concrete is subsequently levelled using the bottom edge of the plate. The plate is again oriented with its length dimension running widthwise of the form. After levelling, the plate is inverted and control joints are laid using the projections.

14 Claims, 2 Drawing Sheets

HAND-HELD SCREED FOR SIDEWALKS

REFERENCE TO RELATED PROVISIONAL APPLICATION

This Application is based on copending Provisional application Ser. No. 60/002,921 filed Aug. 29, 1995, by Stanley Willhoite for "Hand-Held Screed For Sidewalks."

BACKGROUND OF THE INVENTION

1. Field Of the Invention

The present invention relates generally to screeds. More particularly, the present invention relates to such screeds which include strike boards and/or finish blades and are used to level up or strike off and/or finish poured material, especially the concrete for a sidewalk. Still more particularly, the present invention relates to concrete screeds which can be hand-held.

2. Description of the Prior Art

As is well known to those versed in the art, in the laying of concrete slabs for sidewalks, it is customary to drive stakes into the ground, the tops of which are level with each other or are aligned to a certain specified grade. Strips of material are then laid on top of the stakes. The concrete is then poured around the stakes and the strips to just cover the strips so as to make it possible to make the resultant sidewalk level or to a certain grade throughout the area. The more common supports may comprise iron pipes which are supported on top of wooden stakes and held in place by nails driven into the stakes on each side of the pipe.

When form boards cannot be used to support strips of material at the proper elevation and pitch, prior art operators have manually held screeds and/or finishing blades at desired elevations and pitches. Typically, these are used while walking backwards, using only hand-held grips or, as shown in U.S. Pat. No. 4,591,291, hand-held grips in conjunction with an operator-worn, counter-balancing harness. Typically, manually held screeds are very cumbersome and tiring. When employing screeds without a harness, the operators must bend over while moving the screed for the entire length of the slab. Typically, this operation requires the involvement of two persons.

In the past, various patents have issued which relate to such screeds and concrete finishing tools. For example, U.S. Pat. No. 3,451,179, issued on Jun. 24, 1969, teaches a screed support in which a body of sheet metal is bent to form a horizontally extending portion for seating engagement with the top of a stake driven into the ground. At one edge of the horizontal portion is provided an upwardly extending portion formed to provide a seat for a screed pipe or rod.

U.S. Pat. No. 4,520,527, issued on Jun. 4, 1985, to Maggio et al. teaches a concrete finishing tool which enables a user to adjust the angle of a bull float which is adapted for connection to an adapter. The angle of the bull float is adjusted so that it does not gouge into the unset surface of concrete. The adapter includes a base plate, a yoke, a handle-receiving member extending through the yoke, a braking sleeve inside the yoke through which the handle-receiving member passes, and a rod which connects the handle-receiving member to the base plate.

U.S. Pat. No. 4,752,154, issued on Jun. 21, 1988, to R. L. Valentine describes a concrete finishing tool for trowelling and sweeping the surface of a freshly laid concrete slab. The tool includes a trowel member having a front edge and a rear edge. An elongated handle is attached to the trowel member.

A bracket structure serves to allow the attachment of the handle to the trowel member and for allowing the trowel member to be tilted with the rear edge engaging the concrete slab and with the front edge positioned above the concrete slab and pushed along the concrete slab.

U.S. Pat. No. 5,115,536, issued on May 26, 1992, to J. D. Jarvis describes an adjustable concrete finishing tool with a handle which can be readjusted to various angular dispositions. This handle can be used in conjunction with a bull float, a hand trowel, a groover, a finisher, and the like.

U.S. Pat. No. 5,190,401, issued on Mar. 2, 1993, to L. A. Wilson describes a wheeled concrete screed. This screed includes a strike board and a blade assembly. A pair of corresponding main handle members are pivotally mounted to the strike board and blade assembly. A pair of corresponding wheel assemblies are affixed to and extend downwardly from the main handle members. A means is provided to adjust the pitch of the strike board and blade assembly independent of changes in elevation of the strike board and blade assembly.

U.S. Pat. No. 5,269,625, issued on Dec. 14, 1993, to S. R. Stewart teaches a manually operated trowel which can be used for finishing wet concrete. The float portion is a rectangular plate-like structure with a handle mounted to its top center region. The handle can include several extensions.

SUMMARY OF THE INVENTION

It is an object of the present invention to provide a hand-held screed that can be manipulated by a single person.

It is another object of the present invention to provide a hand-held screed that allows the operator to manipulate the screed at a convenient posture.

It is a further object of the present invention to provide a hand-held screed which is easy to use, easy to manufacture, and relatively inexpensive.

These and other objects and advantages of the present invention will become apparent from a reading of the attached specification and appended claims.

One aspect of the invention resides in a hand-held tool for use in paving to a predetermined depth. The tool comprises a subgrading and levelling member having a pair of opposed surface portions, and a handle member connected to the subgrading and levelling member. The handle member is designed and arranged to permit subgrading and levelling with one of the surface portions while standing. The distance between the surface portions is substantially equal to the predetermined depth to thereby permit establishment of the predetermined depth by means of the subgrading and levelling member.

Another aspect of the invention resides in a hand-held tool for use in paving. The tool comprises a subgrading and levelling member having a pair of opposed ends and a pair of opposed surface portions between the ends. The tool further comprises a handle member connected to the subgrading and levelling member, and the handle member is designed and arranged to permit subgrading and levelling with a selected one of the surface portions while standing. An extension member is provided at each of the ends for marking a joint location, and the extension members project away from the selected surface portion beyond the other surface portion.

The subgrading and levelling member preferably includes a rectangular plate-like member which extends transversely to the orientation of the handle member. A bottom edge of the plate-like member can be used for subgrading and levelling. The extension members then each have a portion which extends above the top edge of the plate-like member. The extension members may extend above the top edge of the plate-like member for an equal distance.

A first strut may extend outwardly from the handle member, at an angle, so as to be affixed to a surface of the plate-like member. A second strut may extend from an opposite side of the handle member and is then also affixed to the surface of the plate-like member. The struts serve as supports for the structural stability and integrity of the handle member/plate connection.

The handle member preferably extends at an orientation of 22.5 degrees relative to the flat bottom edge of the plate-like member.

The handle member can include a threaded portion for the purposes of lengthening the handle member or for the attachment of a jointer, grips or other items to the end of the handle member opposite the plate-like member.

An additional aspect of the invention resides in a paving method. The method comprises the steps of subgrading a predetermined area by means of a tool, depositing a flowable and hardenable material over the predetermined area, and levelling the material by means of the tool.

Yet another aspect of the invention resides in a paving method which comprises the steps of subgrading a predetermined area by means of a tool, establishing a predetermined depth by means of the tool during the subgrading step, and depositing a flowable and hardenable material over the predetermined area to approximately the predetermined depth.

A method in accordance with the invention can further comprise the step of marking a joint location by means of the tool.

Additional features and advantages of the invention will be forthcoming from the following detailed description of preferred embodiments when read in conjunction with the accompanying drawings.

DESCRIPTION OF THE PREFERRED EMBODIMENTS

Figure 1:
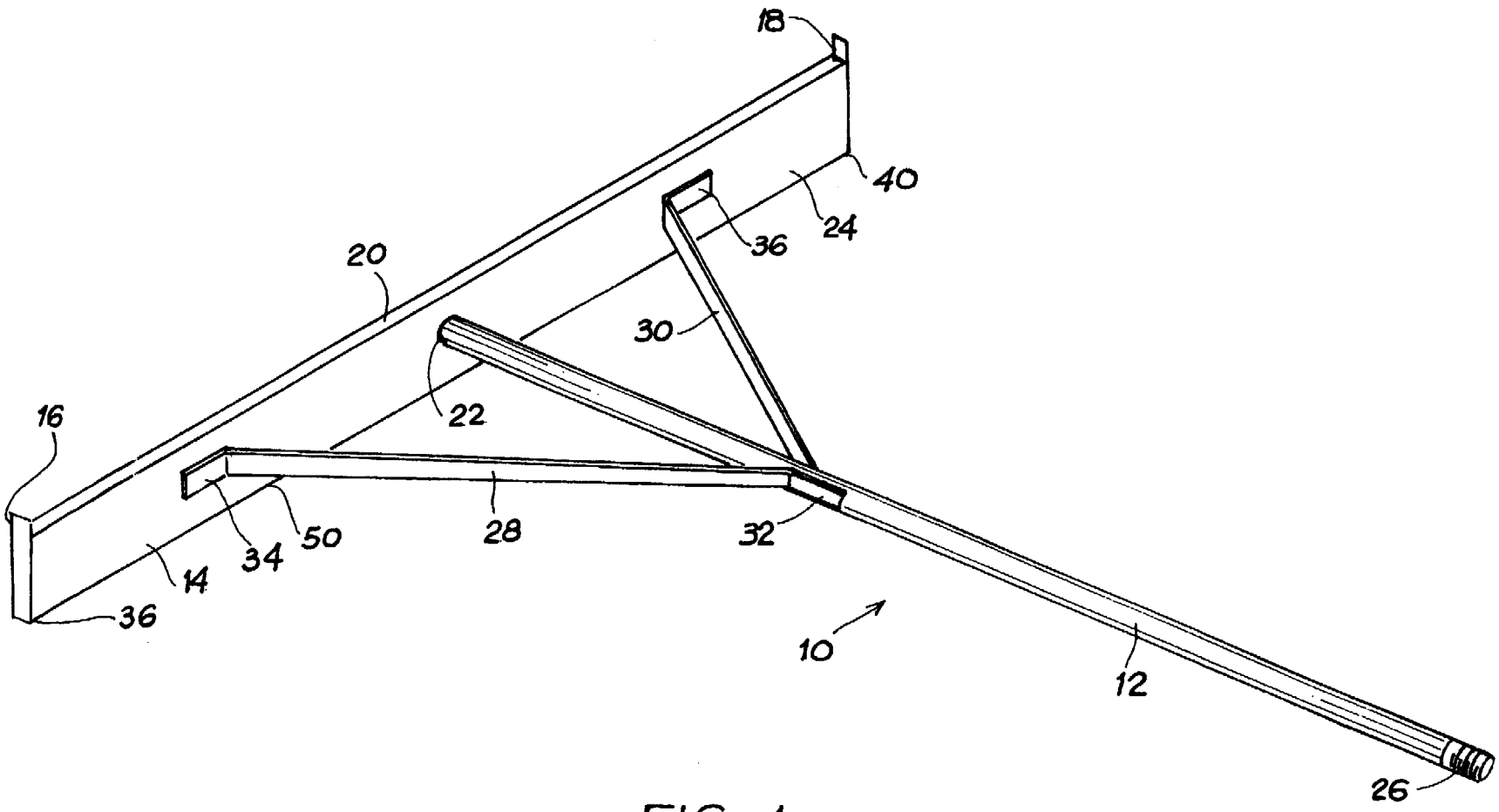
FIG. 1 is a perspective view of the hand-held screed of the present invention.

Referring to FIG. 1, there is shown at 10 the hand-held screed in accordance with the preferred embodiment of the present invention. As can be seen, the hand-held screed 10 includes a handle or handle member 12 and a plate-like subgrading and levelling member 14. The plate-like member 14 extends transversely to the handle 12. The plate-like member 14 is provided with a first extension member 16 and a second extension member 18. The plate-like member 14 has a flat bottom edge or surface portion 50. The flat bottom edge 50 is used for subgrading and for levelling flowable and hardenable material such as concrete.

The handle 12 is a rod-like member that has end 22 affixed to a major surface 24 of the plate-like member 14. The plate-like member 14 has a second major surface which is opposed to the major surface 24 and is not visible. The end 22 can be secured to the surface 24 by a bead weld, or by other attachment means. The opposite end 26 of the handle 12 includes a threaded portion. This threaded portion allows the handle 12 to be affixed to other items. Such other items can include a jointer, an extension handle, a hand grip, or a transverse bar. Alternatively, a leather grip can be wrapped around the threaded end 26 so as to provide a convenient handling surface for the manipulation of the hand-held screed 10 of the present invention.

In FIG. 1, it can be seen that a first strut 28 and a second strut 30 extend outwardly from the handle 12 so as to be secured to the surface 24 of the plate-like member 14. Specifically, the first strut 28 includes a flat portion 32 which is affixed to the outer surface of the handle 12. The second strut 30 includes a similar flat surface. The opposite end of the first strut 28 includes another flattened surface 34 which is affixed to the surface 24 of the plate-like-member 14. The second strut also includes a flat surface 36 which is affixed to the surface 24 of the plate-like member 14. The surfaces 34 and 36 can be secured to the plate-like member 14 by a bead weld, or by other attachment means. The struts 28 and 30 serve to provide structural support for the handle 12. The struts 28 and 30 also provide the hand-held screed with strength and integrity.

The plate-like member 14 is a rectangular plate having the flat bottom edge or surface portion 50 and an opposed top edge or surface portion 20. The bottom edge 50 and top edge 20 constitute the longer edges of the plate-like member 14. A first extension member 16 is provided at an end 38 of the plate-like member 14 and extends upwardly above the top edge 20, preferably for a distance of approximately one inch. Similarly, a second extension member 18 is provided at an opposite end 40 of the plate-like member 14 and extends upwardly above the top edge 20, preferably for a distance of approximately one inch. The ends 38 and 40 include the shorter edges of the plate-like member 14 which, together with the bottom edge 50 and the top edge 20, bound the major surfaces of the plate-like member 14.

Figure 2:
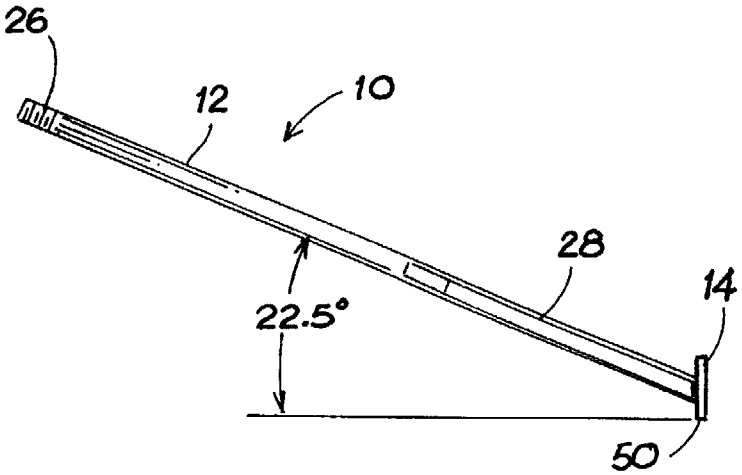
FIG. 2 is a side elevational view of the hand-held screed of the present invention.

FIG. 2 shows a side view of the configuration of the hand-held screed 10 of the present invention. As can be seen, the handle 12 extends at an angle, preferably an angle of 22.5 degrees, relative to the bottom edge 50, or the plane of the bottom edge 50, of the plate-like member 14. The strut 28 is illustrated as extending in alignment with the orientation of the handle 12. The handle 12 is shown as having its threaded portion 26 available for the attachment of other devices. The orientation of the bottom edge 50 with respect to the handle 12 allows the screed 10 of the present invention to be operated at a convenient and efficient angle for a single operator while standing.

Figure 3:
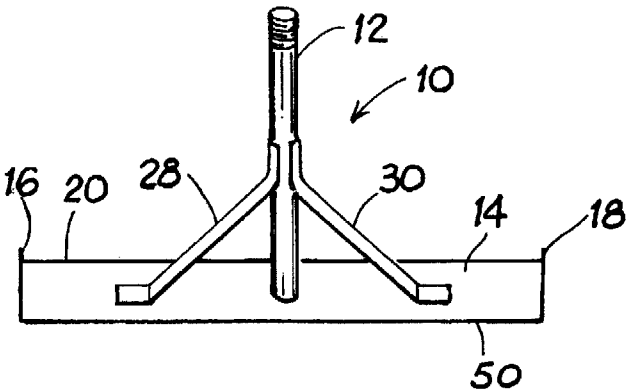
FIG. 3 is an end view of the hand-held screed of the present invention.

FIG. 3 shows an end view of the screed 10 of the present invention. As can be seen, the handle 12 is affixed to the plate-like member 14 and extends upwardly, at an angle, therefrom. The struts 28 and 30 serve to secure the handle 12 in its proper orientation to the plate-like member 14. The extension members 16 and 18 are illustrated as being at the ends of the plate-like member 14 and extending upwardly therefrom. The extension members 16 and 18 extend upwardly above the top edge 20 of the plate-like member 14, preferably by a distance of approximately one inch. The plate-like member 14 has a width, as measured between the bottom edge 50 and the top edge 20, equal or approximately equal to the intended depth of the flowable and hardenable material to be laid. The plate-like member 14 further has a length, as measured between the ends 38 and 40, equal or approximately equal to the width of an area over which the flowable and hardenable material is to be deposited. The bottom edge 50 is used for the levelling of the flowable and hardenable material. The extension members 16 and 18 help a person mark or lay the control joints without help or without the need for tape.

Figure 4:
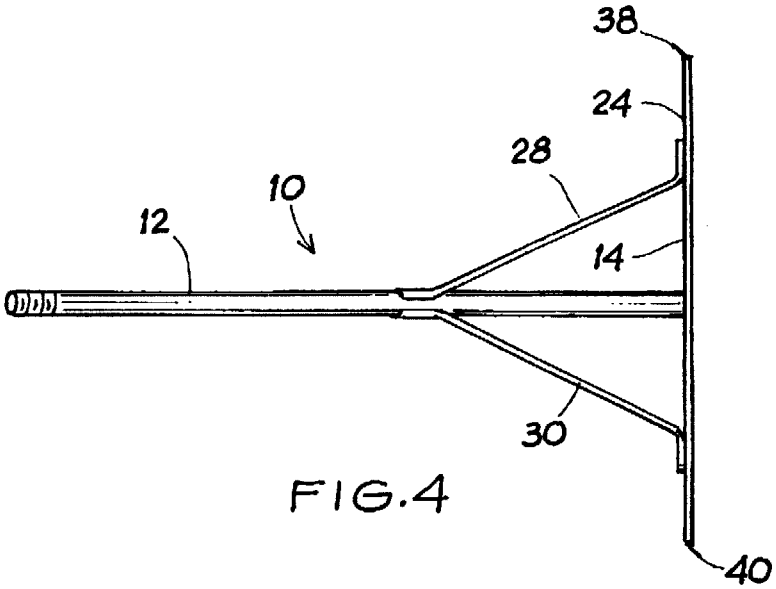
FIG. 4 is a plan view of the hand-held screed of the present invention.

FIG. 4 is an illustration of the screed 10 of the present invention. As can be seen, the handle 12 extends transversely to the surface 24 of the plate-like member 14. The struts 28 and 30 are secured to the handle 12 on opposite sides of the handle 12. The struts 28 and 30 extend in a V-shaped configuration toward the plate-like member 14. The struts 28 and 30 can contact the plate-like member 14 approximately one foot from the ends 38 and 40 of the plate-like member 14.

The hand-held screed of the present invention is preferably made of aluminum. However, it is important to note that, within the concept of the present invention, the screed 10 could be made of a variety of other materials. The extension members 16 and 18 may be discrete from the plate-like member 14 and, in such a case, the extension members 16 and 18 can be secured to the ends 38 and 40 of the plate-like member 14 by spot-welding or by other attachment means.

The screed 10 of the invention can be used to make sidewalks. For such an application, the plate-like member 14 will generally have a width of four inches and a length of four feet because sidewalks are usually four inches deep and are usually made in segments four feet wide.

The screed 10 of the invention can, for instance, have a thickness of one-half inch.

The manner of using the screed 10 of the invention will be described, by way of example, with reference to the making of a concrete sidewalk with a depth of four inches and a width of four feet. The plate-like member 14 then has a width of four inches and a length of four feet.

A form is erected about a predetermined area four feet wide. Erection of the form, which does not constitute part of the present invention, is accomplished in a conventional fashion.

Once the form has been erected, a worker subgrades the predetermined area within the form by means of the flat bottom edge 50 of the plate-like member 14. Conveniently, the plate-like member 14 is positioned with its length dimension running widthwise of the predetermined area. The worker can carry out the subgrading operation while standing by gripping the handle 12 and using the latter to move the flat bottom edge 50 over the predetermined area.

Subgrading continues until the top edge 20 of the screed 10 is flush with the top edges of the form. At such time, the worker knows that the depth of the predetermined area is equal to the intended depth of the concrete to be poured into the form.

The form is now filled with concrete. Once the form has been filled, the worker levels the wet concrete by means of the flat bottom edge 50 of the plate-like member 14. Again, the plate-like member 14 is conveniently positioned with its length dimension running widthwise of the predetermined area bounded by the form. As before, the worker can level the concrete while standing by gripping the handle 12 and using the same to move the flat bottom edge 50 over the concrete.

After the concrete has been levelled, the worker inverts the plate-like member 14 and marks or lays control joints by means of the extension members 16 and 18. The worker can once more accomplish this while standing by holding the handle 12 and using it to move the extension members 16 and 18 along the concrete.

The screed 10 of the present invention is a multipurpose tool which is easy to use and manufacture. Furthermore, the screed 10 allows one person to do the work of three people. The screed 10 also permits subgrading, levelling and the laying of control joints to be carried out while standing erect or almost so thereby greatly reducing the chance of injury to the knees and back.

The foregoing disclosure and description of the invention are illustrative and explanatory thereof. Various changes in the details of the illustrated configuration can be made within the scope of the present invention.

I claim:

1. A hand-held tool for use in paving to a predetermined depth comprising:

a subgrading and levelling member having a pair of opposed ends and a pair of opposed surface portions between said ends;

a handle member connected to said subgrading and levelling member, said handle member being designed and arranged to permit subgrading and levelling with one of said surface portions while standing; and an extension member at each of said ends for marking a joint location, said extension members projecting away from said one surface portion beyond the other of said surface portions, and the distance between said one surface portion and said other surface portion approximately equalling said predetermined depth to thereby permit establishment of said predetermined depth by means of said subgrading and levelling member.

2. The tool of claim 1, wherein said subgrading and levelling member is approximately plate-like and rectangular, said subgrading and levelling member having a pair of opposed shorter edges at said ends and a pair of opposed longer edges which include said surface portions, and said subgrading and levelling member further having a pair of opposed major surface portions which are bounded by said edges, said handle member being connected to one of said major surface portions.

3. The tool of claim 1, wherein said extension members project beyond said other surface portion by approximately the same distance.

4. The tool of claim 3, wherein said distance is approximately one inch.

5. The tool of claim 1, further comprising a pair of struts for bracing said handle member, said struts being inclined to said handle member, and said struts being connected to opposite sides of said handle member and to said subgrading and levelling member.

6. The tool of claim 1, wherein said handle member has an end portion remote from said subgrading and levelling member, said end portion being threaded for attachment to an additional member.

7. The tool of claim 1, wherein said one surface portion defines a predetermined plane and said handle member extends in a predetermined direction which makes an angle of about 22.5 degrees with said predetermined plane.

8. The tool of claim 1 for use in paving an area of predetermined width, wherein said one surface portion has a length approximately equal to said predetermined width.

9. A hand-held tool for use in paving to a predetermined depth comprising:

a subgrading and levelling member having a pair of opposed surface portions; and a handle member connected to said subgrading and levelling member, said handle member being designed and arranged to permit subgrading and levelling with one of said surface portions while standing, and the distance between said surface portions being approximately equal to said predetermined depth to thereby permit establishment of said predetermined depth by means of said subgrading and levelling member.

10. The tool of claim 9 for use in making a sidewalk, wherein said distance is approximately four inches.

11. The tool of claim 9 for use in paving an area of predetermined width, wherein said one surface portion has a length approximately equal to said predetermined width.

12. The tool of claim 11 for use in making a sidewalk, wherein said length is approximately four feet.

13. The tool of claim 9, further comprising a pair of struts for bracing said handle member, said struts being inclined to said handle member, and said struts being connected to opposite sides of said handle member and to said subgrading and levelling member.

14. The tool of claim 9, wherein said one surface portion defines a predetermined plane and said handle member extends in a predetermined direction which makes an angle of about 22.5 degrees with said predetermined plane.

* * * * *